US009429298B1

(12) United States Patent
Hetrick et al.

(10) Patent No.: US 9,429,298 B1
(45) Date of Patent: Aug. 30, 2016

(54) THREE AXIS ADJUSTMENT FOR EMERGENCY LIGHTS EMITTING AN ASYMMETRIC BEAM PATTERN TO ILLUMINATE A PATH OF EGRESS

(71) Applicants: Westly Davis Hetrick, Atlanta, GA (US); Christopher Ladewig, Fayetteville, GA (US)

(72) Inventors: Westly Davis Hetrick, Atlanta, GA (US); Christopher Ladewig, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/829,014

(22) Filed: Mar. 14, 2013

Related U.S. Application Data

(60) Provisional application No. 61/638,358, filed on Apr. 25, 2012, provisional application No. 61/642,325, filed on May 3, 2012.

(51) Int. Cl.
*F21V 17/02* (2006.01)
*F21V 21/26* (2006.01)
*F21V 5/08* (2006.01)

(52) U.S. Cl.
CPC ..... *F21V 5/08* (2013.01)

(58) Field of Classification Search
CPC ... G02B 27/283; G02B 27/285; F16C 11/04; F16C 11/10; F16M 11/14; B32B 2551/00; B60D 1/06; B60G 2204/416; B60N 2/682; H01R 35/025; H04N 5/2254; H05K 5/0204
USPC ..... 362/282; 359/489.14, 491.01; 285/282; 403/164
See application file for complete search history.

(56) References Cited

U.S. PATENT DOCUMENTS

| | | | | |
|---|---|---|---|---|
| 1,955,599 | A * | 4/1934 | Lamblin-Parent | 362/215 |
| 4,654,764 | A * | 3/1987 | Hsiao | 362/199 |
| 4,697,890 | A * | 10/1987 | Crookston et al. | 359/489.14 |
| 4,912,609 | A | 3/1990 | Gillette | |
| 5,258,899 | A * | 11/1993 | Chen | 362/394 |
| 6,193,395 | B1 * | 2/2001 | Logan | 362/285 |
| 6,783,264 | B2 * | 8/2004 | Felty | 362/371 |
| 6,877,880 | B2 * | 4/2005 | Endo | 362/282 |
| 7,641,366 | B1 * | 1/2010 | Sibalich et al. | 362/371 |
| 9,080,747 | B1 | 7/2015 | Hetrick | |
| 2008/0055888 | A1 * | 3/2008 | Sharrah et al. | 362/106 |
| 2008/0266856 | A1 * | 10/2008 | Chien | 362/249 |
| 2008/0276509 | A1 | 11/2008 | Yu | |
| 2009/0310356 | A1 | 12/2009 | Laporte | |
| 2010/0014290 | A1 * | 1/2010 | Wilcox | 362/244 |
| 2013/0258677 | A1 | 10/2013 | Fryzek | |

* cited by examiner

*Primary Examiner* — Jason Moon Han
*Assistant Examiner* — Omar Rojas Cadima
(74) *Attorney, Agent, or Firm* — King & Spalding LLP

(57) ABSTRACT

A light fixture includes a fixture housing and at least one adjustable lighting head assembly coupled thereto. Each lighting head assembly includes a lighting head and a mounting assembly that couples the lighting head to the fixture housing. The lighting head includes a housing, a light source inserted therein, a cover coupled to the distal end of the housing, and an optic lens rotatably disposed between the housing and the cover which produces an asymmetric light output. The mounting assembly includes a rotatable mounting base, a pin head, and a pin extending from the mounting base to the pin head. The pin is inserted through a slot formed within the housing and the pin head slides within the housing along the length of the slot. Hence, the asymmetric light output is adjustable using the rotation of each of the optic lens, the sliding pin head, and the rotatable mounting base.

19 Claims, 5 Drawing Sheets

THREE AXIS ADJUSTMENT FOR EMERGENCY LIGHTS EMITTING AN ASYMMETRIC BEAM PATTERN TO ILLUMINATE A PATH OF EGRESS

CROSS REFERENCE TO RELATED APPLICATIONS

This patent application claims priority under 35 U.S.C. §119(e) to U.S. Provisional Patent Application No. 61/638,358 titled "Three Axis Adjustment For Emergency Lights Emitting An Asymmetric Beam Pattern To Illuminate A Path Of Egress" filed on Apr. 25, 2012, and to U.S. Provisional Patent Application No. 61/642,325 titled "Single Axis Adjustment For Emergency Lights Emitting An Asymmetric Beam Pattern To Illuminate A Path Of Egress" filed on May 3, 2012, the entire contents of both which are hereby incorporated by reference herein.

TECHNICAL FIELD

The present disclosure relates generally to lighting solutions, and more particularly to systems, methods, and devices for providing an emergency lighting fixture that includes one or more light adjustment axis for refining the direction of light emitted therefrom.

BACKGROUND OF THE INVENTION

Emergency lighting is typically used to illuminate a path of egress away from an area experiencing power failure or during other emergency conditions. Conventional emergency lighting fixtures include either a fixed optic or an adjustable lighting head that can be adjusted to aim the light emitted therefrom to the designated path of egress. These adjustable lighting heads typically emit a symmetrical beam of light and have two adjustment axes for aiming the emitted light in a particular direction, which is described in further detail below with respect to FIG. 1. However, there are some adjustable lighting heads that emit an asymmetrical beam, but they do not provide additional adjustment mechanisms, such as an additional adjustment axis, for refining the emitting direction of the asymmetrical beam.

FIG. 1 shows a perspective view of an adjustable lighting head 100 coupled to a mounting pin 150 in accordance with the prior art. Referring to FIG. 1, the adjustable lighting head 100 includes a housing 110, a light source 120, and a lens 130. The housing 110 is parabolic-shaped and includes a sidewall 112 that surrounds a cavity (not shown) and extends to a distal end 114. The distal end 114 defines a light-emitting opening 116. The housing 110 also includes a mounting opening 118 that is formed into the sidewall 112. The housing 110 is fabricated from aluminum, but can be fabricated using other suitable materials, such as a different metal, a metal alloy, or plastic.

The light source 120 is positioned within the cavity and oriented to direct light through the light-emitting opening 116. The light source 120 is any type of light source including, but not limited to, an incandescent, halogen, fluorescent, or compact fluorescent light bulb, a light emitting diode (LED) (including discrete LEDs, LED packages, LED arrays, or chip on board LEDs), and an organic light emitting diode (OLED). The lens 130 is similarly shaped according to the shape of the light-emitting opening 116 and is coupled substantially about the distal end 114 to cover the light-emitting opening 116. The lens 130 emits light from the light source 120 in a symmetrical manner. The lens 130 is fabricated from an acrylic material, but can be fabricated using other suitable materials, such as glass. The lens 130 is fixed in position and is not rotatable once coupled to the housing 110.

The mounting pin 150 is cylindrically shaped and is mounted to the housing 110 within the mounting opening 118. The mounting pin 150 is rotatable, thereby allowing the adjustable lighting head 100 to also rotate circumferentially. The coupling of the mounting pin 150 to the housing 110 is known to people having ordinary skill in the art. The mounting pin 150 is fabricated from aluminum, but can be fabricated using other suitable materials, such as a different metal, a metal alloy, or plastic.

Upon the adjustable lighting head 100 being coupled to the mounting pin 150, the adjustable lighting head 100 is rotatable 360 degrees about a vertical axis. Also, the adjustable lighting head 100 is adjustable less than 90 degrees about a horizontal axis. Thus, there is a first horizontal axis 105 that controls the tilt orientation of the adjustable lighting head 100 and a second vertical axis 107 that controls the rotational orientation of the adjustable lighting head 100.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
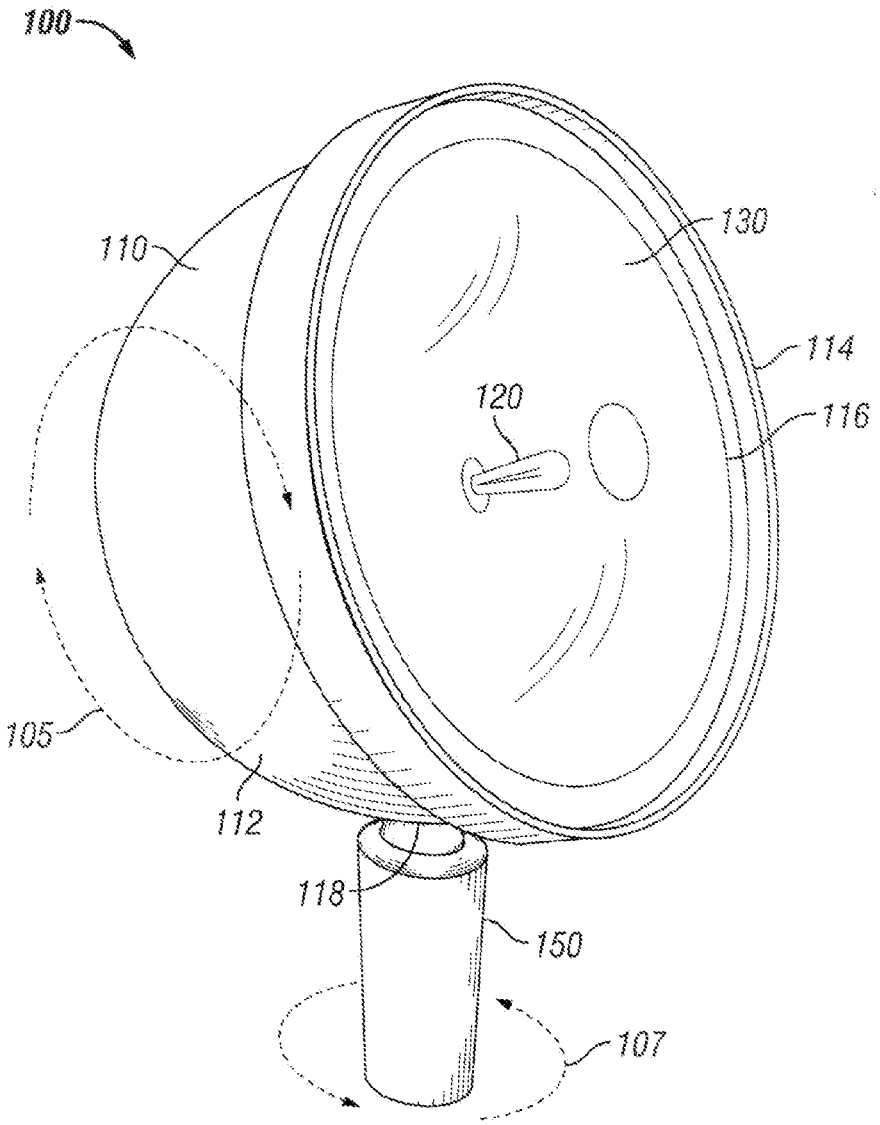
FIG. 1 (Prior Art)
FIG. 1 shows a perspective view of an adjustable lighting head coupled to a mounting pin in accordance with the prior art.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles.

DETAILED DESCRIPTION OF THE EXEMPLARY EMBODIMENTS

The exemplary embodiments disclosed herein are directed to systems, methods, and devices for providing an emergency lighting fixture that includes one or more light adjustment axis for refining the direction of light emitted therefrom. This invention may, however, be embodied in many different forms and should not be construed as limited to the embodiments set forth herein; rather, these embodiments are provided so that this disclosure will be thorough and complete, and will fully convey the scope of the invention to those skilled in the art. The invention is better understood by reading the following description of non-limiting, exemplary embodiments with reference to the attached drawings, wherein like parts of each of the figures are identified by like reference characters, and which are briefly described as follows.

Figure 2A:
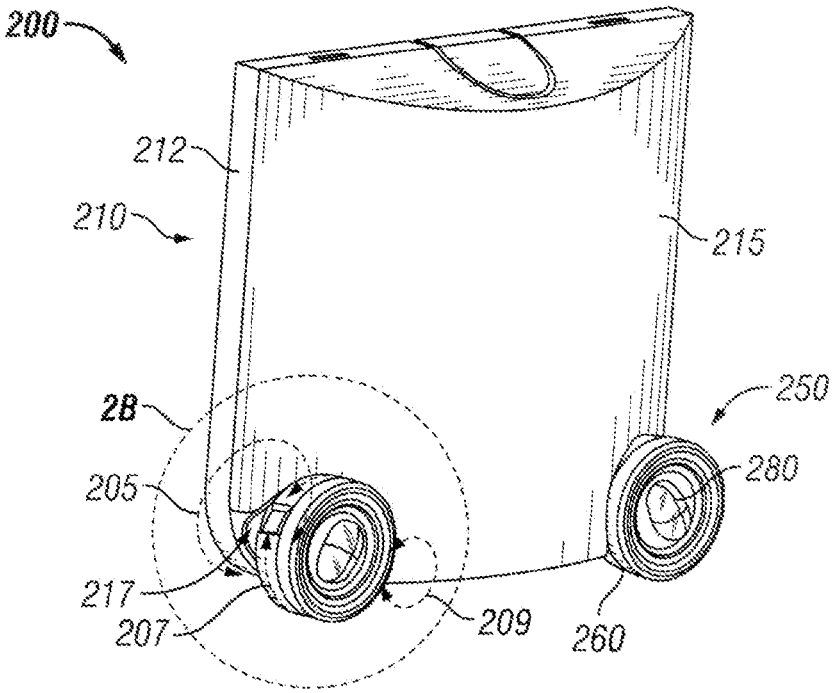
FIG. 2A is a perspective view of an emergency lighting fixture in accordance with an exemplary embodiment.
Figure 2B:
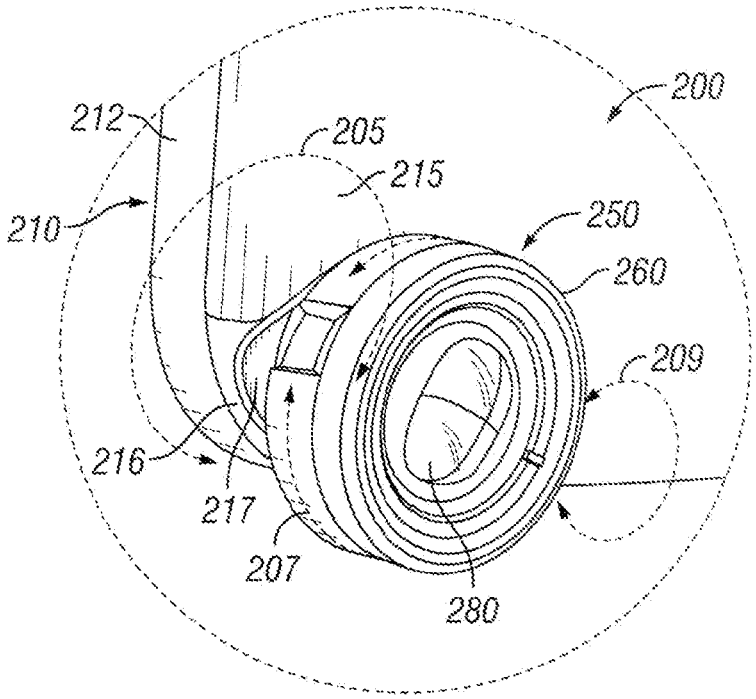
FIG. 2B is a partial perspective view of the emergency lighting fixture of FIG. 2A illustrating an adjustable lighting head assembly coupled to a fixture housing in accordance with an exemplary embodiment.

FIG. 2A is a perspective view of an emergency lighting fixture 200 in accordance with an exemplary embodiment. FIG. 2B is a partial perspective view of the emergency lighting fixture 200 illustrating an adjustable lighting head assembly 250 coupled to a fixture housing 210 in accordance with an exemplary embodiment. Referring to FIGS. 2A and 2B, the emergency lighting fixture 200 includes the fixture housing 210 and one or more adjustable lighting head assemblies 250 coupled to the fixture housing 210. Emergency lighting fixtures, as used within this disclosure, includes any and all types of emergency lighting devices and egress lighting devices which includes, but is not limited to, exit signs. Although the description herein has been provided with respect to emergency lighting devices, the description is applicable to any lighting fixture type.

The fixture housing 210 includes a base panel 212 and a cover panel 215 that couples to the base panel 212. The cover panel 215 snaps onto the base panel 212; however, the cover panel 215 is coupled to the base panel 212 in other manners, such as by using screws or latches, in other exemplary embodiments. The base panel 212 and the cover panel 215, when coupled to one another, collectively form a cavity (not shown) therein which houses one or more electronic devices (not shown), such as an LED driver or ballast (depending on the light source), localized temporary power source (such as a battery or supercapacitor) and wiring to couple the fixture to a power source. The cover panel 215 includes one or more recesses 217 formed therein, each recess having an aperture 501 (FIG. 5) formed therethrough. Each recess 217 receives at least a portion of a respective adjustable lighting head assembly 250 which mounts to the cover panel 215. According to some exemplary embodiments, two recesses 217 are formed adjacent each of the opposing bottom edges 216 of the cover panel 217; however, these recesses 217 are formed elsewhere along the cover panel 215 according to alternative exemplary embodiments. Further, although two recesses 217 are formed within the cover panel 215, greater or fewer recesses are formed in other exemplary embodiments. The fixture housing 210 is fabricated using a plastic, but is alternatively fabricated using other suitable materials, such as aluminum, other metals, or metal alloys, in other exemplary embodiments.

The adjustable lighting head assembly 250 includes a mounting assembly 310 (FIGS. 3A-3E) and an adjustable lighting head 260. The adjustable lighting head assembly 250 is coupled to the cover panel 215 using the mounting assembly 310 (FIGS. 3A-3E), which is described in further detail below. Upon the adjustable lighting head assembly 250 being coupled to the fixture housing 210, the adjustable lighting head assembly 250 includes three axes of rotation that facilitate in refining the direction light that is emitted from the adjustable lighting head assembly 250. The adjustable lighting head 260 is rotatable about 355 degrees about a vertical axis because of a stop mechanism 301 (FIGS. 3C and 3E) extending outwardly from the mounting assembly 310 (FIGS. 3A-3E) which interacts with a protrusion (not shown) extending inwardly from an inner surface of the recess 217 formed in the cover panel 215. The rotation of the adjustable lighting head 260 can be reduced by placing at least one other protrusion extending inwardly from an inner surface of the recess 217 or be changed by increasing or decreasing the thickness of either or both of the stop mechanism 301 (FIGS. 3C and 3E) or the protrusion. Also, the adjustable lighting head 260 is adjustable about ninety degrees in an up/down orientation about a first horizontal axis, which is about forty-five degrees in an upward direction and about forty-five degrees in a downward direction. In alternative exemplary embodiments, the adjustable lighting head 260 is adjustable either greater than ninety degrees total or less than ninety degrees total in an up/down orientation about the first horizontal axis by changing the length, either increasing or decreasing the length, of the slot 365 (FIGS. 3B, 3D, and 3E). Further, the adjustable lighting head 260 includes an optic lens 280 which is rotatable 360 degrees about a second horizontal axis that is orthogonal to or substantially orthogonal to the first horizontal axis. Thus, there is a first rotational axis 205 that controls the tilt orientation of the adjustable lighting head 260, a second rotational axis 207 that controls the rotational orientation of the adjustable lighting head 260, and a third rotational axis 209 that controls the rotational orientation of the optic lens 280. According to certain exemplary embodiments, rotation of the adjustable lighting head 260 about the second rotational axis 207 also causes rotation of the adjustable lighting head 260 about the first rotational axis 205, unless the adjustable lighting head 260 is positioned in the middle of the slot 365 (FIGS. 3B, 3D, and 3E). Hence, the rotation of the optic lens 280 about the third rotational axis 209 provides for better directional control of the light emitted from the adjustable lighting head 260. The adjustable lighting head assembly 250 and the rotational axes 205, 207, 209 are further described with respect to FIGS. 3A-4 below.

Figure 3A:
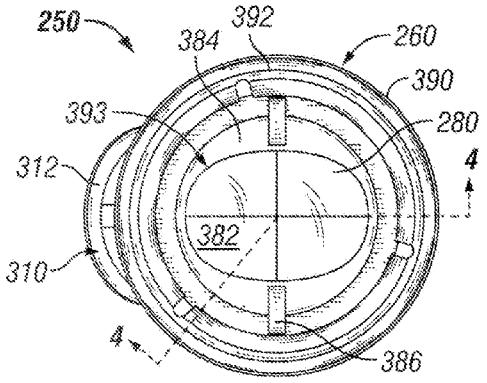
FIGS. 3A-3E are several views of the adjustable lighting head assembly of FIG. 2A in accordance with an exemplary embodiment.
Figure 3B:
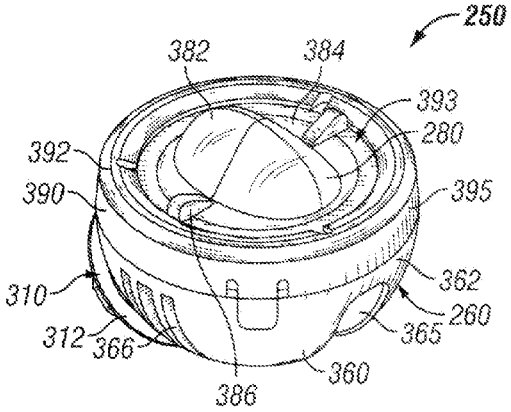
Figure 3C:
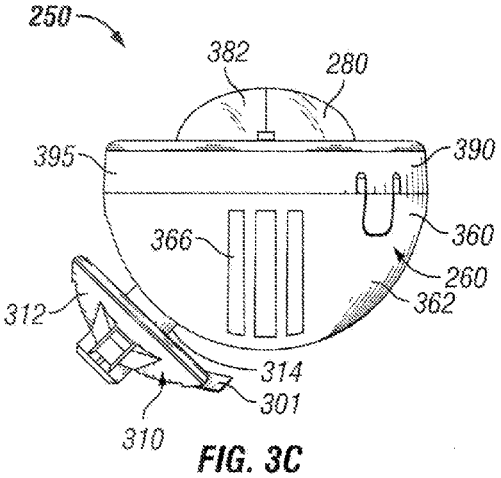
Figure 3D:
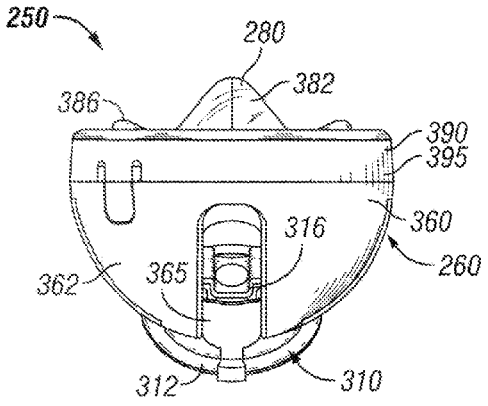
Figure 3E:
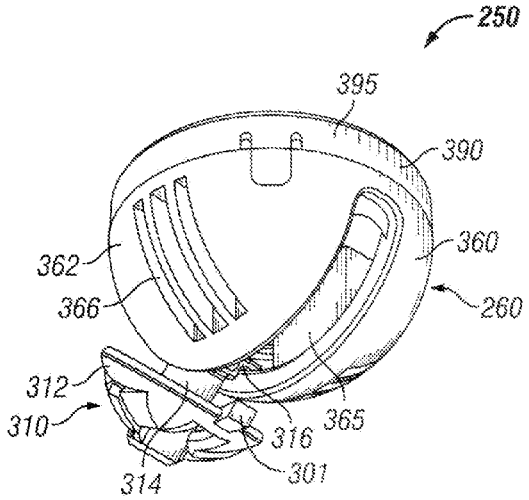
Figure 4:
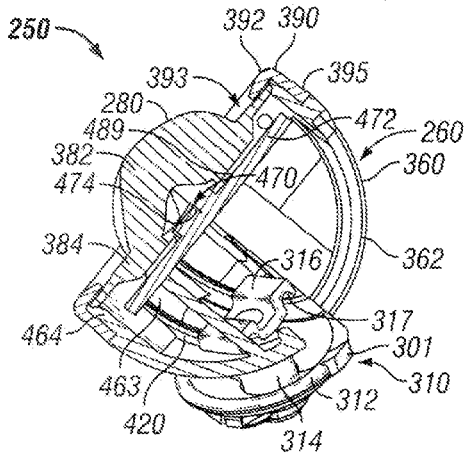
FIG. 4 is a cross-sectional view of the adjustable lighting head assembly of FIG. 2A in accordance with an exemplary embodiment.

FIGS. 3A-3E are several views of the adjustable lighting head assembly 250 in accordance with an exemplary embodiment. FIG. 4 is a cross-sectional view of the adjustable lighting head assembly 250 in accordance with an exemplary embodiment. Referring to FIGS. 3A-4, the adjustable lighting head assembly 250 includes the mounting assembly 310 and the adjustable lighting head 260.

The mounting assembly 310 includes a mounting base 312, a pin 314, and a pin head 316. The mounting base 312 is shaped and configured to be coupled to the fixture housing 210 (FIG. 2A) within the recess 217 (FIG. 2A). The pin 314 is cylindrically shaped and extends away from the pin head 316, which is square or rectangularly-shaped. However, the pin 314 and/or the pin head 316 is shaped differently in alternative exemplary embodiments. In some exemplary embodiments, the pin 314 and the pin head 316 are fabricated as a single component. The pin 314 is coupled to the mounting base 312 according to one or more methods known to people having ordinary skill in the art. As previously mentioned, the stop mechanism 301 extends outwardly from the perimeter of the mounting base 312, thereby allowing the mounting base 312 to be rotatable less than 360 degrees when coupled to the cover panel 215 (FIGS. 2A and 2B) due to the protrusion formed on the inner surface of the recess 217 (FIGS. 2A and 2B). The stop mechanism 301 prevents continuous rotation in one-direction of the mounting base 312. In certain exemplary embodiments, the mounting base 312 is rotatable about 355 degrees, but this rotation can be increased or decreased in other exemplary embodiments. Further, since, the mounting base 312 is rotatable less than 360 degrees when coupled to the cover panel 215 (FIGS. 2A and 2B), the adjustable lighting head 260 also is rotatable less than 360 degrees, or the same as the mounting base 312, about the second rotational axis 207 (FIG. 2B) once the adjustable lighting head assembly 250 is coupled to the fixture housing 210 (FIG. 2A). The pin head 316 includes a groove 317 at opposing edges which facilitates coupling of the mounting assembly 310 to the adjustable lighting head 260 and also facilitates movement of the adjustable lighting head 260 with respect to the mounting assembly 310.

The adjustable lighting head 260 includes a housing 360, a light source 470, an optic lens 280, and a cover 390. The housing 360 can have a parabolic shape or any other desired shape and includes a sidewall 362 that forms a cavity 463 therein and extends to a distal end 464. The distal end 464 defines a light-emitting opening (not shown). The housing 360 also includes a slot 365 that is formed through the sidewall 362 and one or more ventilation openings 366. The slot 365 extends in a longitudinal direction along the sidewall 362 and extends through the vertex of the parabolic-shaped housing 360. A track 420 is formed along each of the opposite longitudinal edges of the slot 365. The ventilation openings 366 are formed through the housing 360 and allow heat generated from the light source 470 to escape from the interior of the housing 360 to an area exterior of the housing 360. The housing 360 is coupled to the mounting assembly 310 using the pin head 316. Specifically, each of the grooves 317 of the pin head 316 is coupled to the corresponding track 420, thereby allowing the adjustable lighting head 260 to be tiltable in an upward and/or downward direction with respect to the mounting assembly 310 once the adjustable lighting head assembly 250 is coupled to the fixture housing 210 (FIG. 2A). The housing 360 is fabricated from a plastic, but can be fabricated using other suitable materials, such as aluminum, some other different metal, or a metal alloy.

In one exemplary embodiment, the light source 470 includes a substrate 472 and one or more LED die packages 474, or LEDs, coupled onto the surface of the substrate 472. Although the light source 470 is described as being an LED die package, or LED, the light source 470 can be any other type of light source. The substrate 472 includes one or more sheets of ceramic, metal, laminate, circuit board, Mylar®, or another suitable material. Each LED die package 474, or LED, includes a chip of semi-conductive material (not shown) that is treated to create a positive-negative ("p-n") junction (not shown). When the LED die packages 474, or LEDs, are electrically coupled to a power source (not shown), current flows from the positive side to the negative side of each junction, causing charge carriers to release energy in the form of incoherent light. The light source 470 is disposed within the cavity 463 and is oriented to emit light through an area surrounded by the distal end 464.

In certain exemplary embodiments, the optic lens 280 is fabricated from an acrylic material. However, according to some alternative exemplary embodiments, the optic lens is fabricated from other suitable materials, such as glass and polymers, that are either transparent or translucent. The optic lens 280 includes a dome portion 382 and a base portion 384 surrounding the dome portion 382. The optic lens 280 is disposed over the light source 470 and is shaped to manipulate the light emitted from the light source 470. The dome portion 382 extends outwardly from the base portion 384 and in a direction away from the light source 470 one disposed over the light source 470. In certain exemplary embodiments, the dome portion 382 is asymmetrically shaped, thereby producing an asymmetric beam output. Although the dome portion 382 is asymmetrically shaped in certain exemplary embodiments, the dome portion 382 is symmetrically shaped in other exemplary embodiments and produces an asymmetric light output using devices such as mirrors, prisms, TIRs, or other known methods to produce an asymmetric beam output. For example, the dome portion 382 is a round-shaped cone in some exemplary embodiments, while the dome portion 382 is an elliptical-shaped cone in other exemplary embodiments. The base portion 384 is placed onto the housing's distal end 464 such that the optic lens 280 forms a gap 489 between the optic lens 280 and the substrate 472. The optic lens 280 is rotatable 360 degrees and moves about the housing's distal end 464. The base portion 384 also includes one or more control surfaces 386 that extend away from the base portion 384 in a similar direction as the dome portion 382. These control surfaces 386 facilitate rotation of the optic lens 280 by using an operator's fingers or a tool. According to some exemplary embodiments, since the optic lens 280 produces an asymmetric light output, rotation of the optic lens 280 allows an operator to further refine the direction of light output.

The cover 390 includes a base wall 392 and a sidewall 395 extending substantially perpendicular away from the perimeter of the base wall 392. The base wall 392 is formed with an opening 393 therein. The cover 390 is coupled to the housing 360. Once the cover 390 is coupled to the housing 360, the base wall 392 is disposed on an outer portion of the optic lens' base portion 384. Thus, a portion of the optic lens' base portion 384 is securely disposed between the housing's distal end 464 and the cover 390. The cover 470 is fabricated from a plastic, but is fabricated using other suitable materials, such as aluminum, some other different metal, or a metal alloy.

Although one example has been provided which allows the optic lens 280 to rotate about 360 degrees, the adjustable lighting head 260 can be fabricated in different manners to allow the optic lens 280 to rotate. For example, in some alternative exemplary embodiments, the cover 390 and the housing 360 can be fabricated as a single component such that the optic lens 280 can be snapped into and/or trapped within a groove (not shown) formed within the single component. The groove is positioned at a location substantially similar to the positioning of the distal end 464. In these alternative exemplary embodiments, the optic lens 280 is rotatable 360 degrees within the groove.

Figure 5:
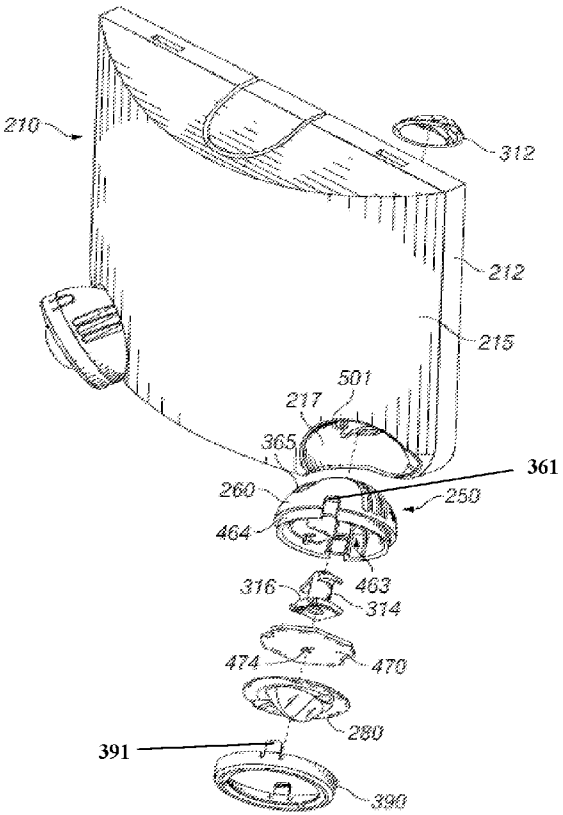
FIG. 5 is an exploded view of the adjustable lighting head assembly when coupled to the fixture housing of FIG. 2A in accordance with an exemplary embodiment.

FIG. 5 shows an exploded view of the adjustable lighting head assembly 250 when coupled to the fixture housing 210 in accordance with an exemplary embodiment of the present invention. Referring to FIG. 5, the pin 314 coupled to the pin head 316 are collectively inserted into the cavity 463 of the housing 260, where at least a portion of the pin 314 extends through the slot 365. The light source 470 is inserted into the cavity 463 of the housing 260 and oriented such that the LED 474 directs light towards the optic lens 280. The optic lens 280 is disposed over the light source 470 and is positioned onto the distal end 464 of the housing 260. The cover 390 is coupled to the housing 260 and securely and rotatably positions the optic lens 280 between the cover 390 and the distal end 464 of the housing 260. In particular, as shown in FIG. 5, the cover 390 may include one or more tabs 391 extending from the sidewall 395 in a direction away from the base wall 392. Further, the housing 360 may include one or more notches 361 located on the sidewall 362 located substantially near the distal end 464 of the housing 360. The one or more tabs 391 of the cover 390 may snap fit into the respective one or more notches 361 of the housing 360 in order to couple and secure the cover 390 to the housing 360. The housing 260 is inserted into the recess 217 of the cover panel 215 and the pin 314 is inserted through the aperture 501 formed within the recess 217. The mounting base 312 is positioned on an opposite side of the cover panel 215, within the fixture housing 210, when compared with the adjustable lighting head 260 and is coupled to an end of the pin 314 which extends through the aperture 501.

The adjustable lighting head assembly 250 provides for three rotational axes to adjust and refine the direction of light output from the light source 470. The adjustable lighting head 260 is rotatable less than 360 degrees, about 355 degrees according to some exemplary embodiments, in a sideways orientation about a vertical axis and is adjustable less than forty-five degrees, or up to a total of about ninety degrees, in an up/down orientation about a first horizontal axis. Further, the adjustable lighting head 260 includes the optic lens 280 which is rotatable 360 degrees about a second horizontal axis that is orthogonal to or substantially orthogonal to the first horizontal axis. Thus, the first rotational axis 205 (FIG. 2A) controls the tilt orientation of the adjustable lighting head 260; the second rotational axis 207 (FIG. 2A) controls the rotational orientation of the adjustable lighting head 260; and the third rotational axis 209 (FIG. 2A) controls the rotational orientation of the optic lens 280.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

We claim:

1. An adjustable lighting head, comprising:

a housing comprising a sidewall that extends to a distal end, the sidewall surrounding a cavity formed within the housing, the distal end surrounding a light emitting opening formed adjacent to the cavity;

a light source positioned within the cavity and oriented to emit light through the light emitting opening;

an optic lens comprising a dome portion and a base portion surrounding the dome portion, wherein the base portion of the optic lens is disposed over the light source; and a cover coupled to the housing and comprising a base wall and a side wall, wherein the side wall extends substantially perpendicularly and away from a perimeter of the base wall, and wherein the base wall of the cover is disposed on an outer perimeter of the optic lens' base portion, wherein the optic lens is rotatably positioned between the distal end of the housing and the cover by securely disposing the outer perimeter of the optic lens between the distal end of the housing and the base portion of the cover, wherein the optic lens is in direct contact with both the base wall of the cover and the distal end of the housing, wherein the cover includes one or more tabs extending from the side wall of the cover, wherein the one or more tabs of the cover snap fits into respective one or more notches located on the sidewall of the housing to couple and secure the cover to the housing such that when the cover is coupled to the housing, the optic lens rotates independent of the housing and the cover about a first axis, the first axis extending substantially perpendicularly from the optic lens and including a center portion of the optic lens, wherein the optic lens produces an asymmetric light beam output, and wherein an orientation of the asymmetric light beam output changes while a shape of the asymmetric light beam remains substantially constant when the optic lens is rotated.

2. The adjustable lighting head of claim 1, wherein the light source comprises one or more light emitting diodes (LEDs).

3. The adjustable lighting head of claim 1, wherein the domed portion is asymmetrically shaped.

4. The adjustable lighting head of claim 1, wherein the optic lens further comprises one or more control surfaces for facilitating rotation of the optic lens.

5. The adjustable lighting head of claim 1, wherein the optic lens is rotatable up to 360 degrees or less.

6. An adjustable lighting head assembly, comprising:

an adjustable lighting head, comprising:

a housing comprising a sidewall that extends to a distal end and a slot that is formed on and through the sidewall of the housing, the sidewall surrounding a cavity formed within the housing, the distal end surrounding a light emitting opening formed adjacent to the cavity, wherein the slot extends in a longitudinal direction along the sidewall of the housing and through the vertex of the housing;

a light source positioned within the cavity and oriented to emit light through the light emitting opening;

an optic lens disposed over the light source and in contact with the distal end; and a cover coupled to the housing and comprising a base portion and a side portion, wherein the base portion covers an outer perimeter of the optic lens; and a mounting assembly coupled to the housing and passing through the slot, wherein the optic lens is rotatably positioned between the distal end of the housing and the cover by securely disposing the outer perimeter of the optic lens between the distal end of the housing and the base portion of the cover, wherein the cover includes one or more tabs extending from the side portion of the cover, wherein the one or more tabs of the cover snap fits into respective one or more notches located on the sidewall of the housing to couple and secure the cover to the housing such that when the cover is coupled to the housing, the optic lens rotates independent of the housing and the cover about a first axis, the first axis extending substantially perpendicularly from the optic lens and including a center portion of the optic lens, wherein the optic lens produces an asymmetric light beam output, and wherein an orientation of the asymmetric light beam output changes while a shape of the asymmetric light beam remains substantially constant when the optic lens is rotated.

7. The adjustable lighting head assembly of claim 6, wherein the slot defines a second axis extending substantially perpendicularly away from a center portion of the slot, the adjustable lighting head being rotatable about the second axis.

8. The adjustable lighting head assembly of claim 7, wherein the mounting assembly comprises:

a mounting base;

a pin head positioned at least partially within the housing adjacent the slot; and a pin extending from the mounting base to the pin head, wherein the pin head is movable along a length of the slot.

9. The adjustable lighting head assembly of claim 8, wherein the housing further comprises a track formed along each longitudinal edge of the slot, the pin head being movably coupled to each of the tracks.

10. The adjustable lighting head assembly of claim 8, wherein the adjustable lighting head is tiltable up to about 45 degrees in opposing directions, about 90 degrees total, with respect to the mounting assembly when moving the pin head along the slot.

11. The adjustable lighting head assembly of claim 6, wherein the optic lens comprises:

a raised domed portion; and a flat portion extending about a perimeter of the raised domed portion.

12. The adjustable lighting head assembly of claim 10, wherein the domed portion is asymmetrically shaped.

13. The adjustable lighting head assembly of claim 6, wherein the optic lens is rotatable up to 360 degrees or less.

14. A light fixture, comprising:

a fixture housing; and at least two adjustable lighting head assemblies coupled to the fixture housing, each adjustable lighting head assembly, comprising:

an adjustable lighting head, comprising:

a housing comprising a sidewall that extends to a distal end and a slot that is formed on and through the sidewall of the housing, the sidewall surrounding a cavity formed within the housing, the distal end surrounding a light emitting opening formed adjacent to the cavity, wherein the slot extends in a longitudinal direction along the sidewall of the housing and through the vertex of the housing;

a light source positioned within the cavity and oriented to emit light through the light emitting opening;

an optic lens disposed over the light source and in contact with the distal end; and a cover coupled to the housing and comprising a base portion and a side portion, wherein the base portion is disposed over an outer perimeter of the optic lens such that the base portion covers the outer perimeter of the optic lens; and a mounting assembly coupled to the fixture housing and the housing of the adjustable lighting head through the slot, wherein the optic lens is rotatably positioned between the distal end of the housing and the cover by securely positioning the outer perimeter of the optic lens between the distal end of the housing and the base portion of the cover, wherein the cover includes one or more tabs extending from the side portion of the cover, wherein the one or more tabs of the cover snap fits into respective one or more notches located on the sidewall of the housing to couple and secure the cover to the housing such that when the cover is coupled to the housing, the optic lens rotates independent of the housing and the cover about a first axis, the first axis extending substantially perpendicularly from the optic lens and including a center portion of the optic lens, wherein the optic lens produces an asymmetric light beam output, and wherein an orientation of the asymmetric light beam output changes while a shape of the asymmetric light beam remains substantially constant when the optic lens is rotated.

15. The light fixture of claim 14, wherein the slot defines a second axis extending substantially perpendicularly away from a center portion of the slot, the adjustable lighting head being rotatable about the second axis.

16. The light fixture of claim 15, wherein the mounting assembly comprises:

a mounting base positioned within the fixture housing;

a pin head positioned at least partially within the housing of the adjustable lighting head adjacent the slot; and a pin extending from the mounting base, through an aperture formed within the fixture housing, and to the pin head, wherein the pin head is movable along a length of the slot and about a third axis.

17. The light fixture of claim 16, wherein the mounting assembly defines the third axis extending substantially longitudinally and centrally along the length of the mounting assembly, the adjustable lighting head being rotatable about the third axis.

18. The light fixture of claim 17, wherein the mounting assembly further comprises a mounting base and a stop mechanism extending outwardly from a portion of a perimeter of the mounting base, the stop mechanism preventing continuous one-direction rotation of the mounting base.

19. The light fixture of claim 14:

wherein the fixture housing comprises a cavity formed by a cover panel that is coupled to a base panel and configured to house one or more electrical components, wherein the cover panel comprises at least two recess structures that are integral to the cover panel, each recess structure housing a portion of one of the adjustable lighting head assemblies, wherein each recess structure is located at opposing corners of a bottom edge of the cover panel to illuminate a path of egress, and wherein each recess includes an aperture that is configured to receive a portion of the mounting assembly therethrough in order to couple the adjustable lighting head assembly to the fixture housing.

* * * * *